US008636322B1

(12) United States Patent
Huang

(10) Patent No.: US 8,636,322 B1
(45) Date of Patent: Jan. 28, 2014

(54) SEAT BACKREST AUTO BACK-UP UNIT

(71) Applicant: Hong Woei Enterprise Co., Ltd., Tainan (TW)

(72) Inventor: Kun-Tsung Huang, Tainan (TW)

(73) Assignee: Hong Woei Enterprise Co., Ltd., Tainan (TW)

( * ) Notice: Subject to any disclaimer, the term of this patent is extended or adjusted under 35 U.S.C. 154(b) by 0 days.

(21) Appl. No.: 13/672,913

(22) Filed: Nov. 9, 2012

(51) Int. Cl.
*A47C 1/024* (2006.01)
*A47C 3/00* (2006.01)
*A47C 7/00* (2006.01)

(52) U.S. Cl.
USPC ..... 297/301.5; 297/292; 297/291

(58) Field of Classification Search
USPC ..... 297/354.1, 285, 291, 292, 301.1, 301.4, 297/301.5, 302.5
See application file for complete search history.

(56) References Cited

U.S. PATENT DOCUMENTS

| | | | | |
|---|---|---|---|---|
| 349,907 | A * | 9/1886 | Shults | 297/292 |
| 376,886 | A * | 1/1888 | Holden | 297/292 |
| 1,543,367 | A * | 6/1925 | Carr | 297/301.4 |
| 2,587,822 | A * | 3/1952 | Corning | 403/220 |
| 4,869,552 | A * | 9/1989 | Tolleson et al. | 297/296 |
| 6,116,687 | A * | 9/2000 | Vogtherr | 297/300.1 |
| 6,896,327 | B1 * | 5/2005 | Barile, Sr. | 297/297 |
| 7,021,712 | B2 * | 4/2006 | Spendlove et al. | 297/285 |
| 7,416,252 | B2 * | 8/2008 | Lor | 297/285 |
| 2008/0238165 | A1 * | 10/2008 | Freestone et al. | 297/301.5 |

FOREIGN PATENT DOCUMENTS

| | | |
|---|---|---|
| TW | 424460 | 2/1989 |
| TW | 472546 | 2/1990 |
| TW | 476263 | 12/1990 |

* cited by examiner

*Primary Examiner* — Milton Nelson, Jr.

(74) *Attorney, Agent, or Firm* — Rosenberg, Klein & Lee

(57) ABSTRACT

A seat includes a back-up unit which includes a shaft fixed to the rear side of a backrest and the two ends of the shaft are pivotably connected to two armrests of the seat. A resilient member is mounted to the shaft and a restriction unit is connected to the shaft. The backrest tilts backward when a user sits in the seat and pivots forward to its upright position by the resilient member and the restriction unit when the user leaves from the seat.

2 Claims, 6 Drawing Sheets

SEAT BACKREST AUTO BACK-UP UNIT

BACKGROUND OF THE INVENTION

1. Fields of the Invention

The present invention relates to an auto back-up unit, and more particularly, to a seat backrest auto back-up unit which automatically backs the backrest upright when the user leaves the seat.

2. Descriptions of Related Art

The conventional seats in public sites such as theaters, performance centers, bus stations or airports are arranged in rows and the distance between the front row and the rear row usually fixed. The backrest of the seat is positioned at an angle relative the seat portion. However, the inclined backrest reduces the distance between the front and rear rows of the seats and also restricts the speed for the users to leave from the public sites. The limited distance between the front and rear rows of the seats can be a problem during in emergent situations.

Taiwan Publication No. 424460 discloses a folding mechanism for a seat, wherein the seat portion is pivotably connected between two armrests and a weight is connected to the rear side of the seat portion. When the seat is empty, the seat portion is automatically pivoted upward. A U-shaped link is connected on the weight and is fixed to a curved guide plate under the backrest. The mediate portion of the backrest is pivotably connected to the seat frame so that when the user leaves from the seat portion, the seat portion pivots upward and the U-shaped link pushes the curved guide plate to back up the backrest so that the space between the front and rear rows of the seats is maintained the expected width.

Taiwan Publication No. 472546 discloses an auto back-up mechanism for a seat, and comprises a base fixed on the floor and a pressing member fixed to the base. The pressing member has a compression section. A seat pad is pivotably connected to the base by a pivot so that the seat pad is positioned at a first position and a second position. The pivot has an eccentric section which is compressed by the compression section so as to keep the seat pad at the first position. When applying a force to the seat pad to pivot the seat pad toward the second position, the eccentric section receives a reaction force from the compression section in reverse direction.

Taiwan Publication No. 476263 discloses a mechanism for folding a seat, and comprises two L-shaped frames, the upright portions of the frames are connected to the backrest and the horizontal portions of the frames are connected to the seat portion. A hole is defined in the mediate portion of each of the frames and two bases each have a pivot which is pivotably connected to the hole. A slot is defined in the horizontal portion. A resilient member is connected between the pivot and a pin on the front end of the horizontal portion. When the user rests on the backrest, the frames swing backward, and the horizontal portion slides along the slot and the resilient member is stretched and contacts the end of the slot to restrict the angle that the horizontal portion slides. The resilient member moves the horizontal portion back when the user leaves from the seat.

U.S. Pat. Nos. 2,492,107, 5,918,937 and 1,29,413 disclose a mechanism between the seat portion and the backrest and/or armrests so that when folding the seat, the backrest is pivoted to a desired position of angle. The backrest can be positioned at the upright position when the user leaves from the seat to maintain the distance between the seats, however, the mechanism is complicated and takes a lot of time to be assembled. The maintenance cost is high and too many parts are involved.

The present invention intends to provide an auto back-up unit for a seat and which improves the shortcomings of the present invention.

SUMMARY OF THE INVENTION

The present invention relates to a seat and comprises a seat portion and a backrest. A back-up unit is connected to the backrest and comprises a shaft fixed to the rear side of the backrest by at least one positioning member. Two ends of the shaft are pivotably connected to two armrests of the seat. A resilient member is mounted to the shaft and comprises a positioning end and a contact end. The positioning end is fixed to the shaft and the contact end contacts the backrest. A restriction unit is connected to the shaft and has a first restriction portion and a second restriction portion. The first restriction portion restricts the inclination of the backrest and the second restriction portion restricts the angle of the backrest when the backrest backs up.

The primary object of the present invention is to provide an auto back-up unit for a seat, wherein the backrest tilts backward when a user sits in the seat and pivots forward to its upright position by the resilient member and the restriction unit when the user leaves from the seat.

Preferably, a weight is connected beneath the backrest so as to assist the operation of the resilient member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
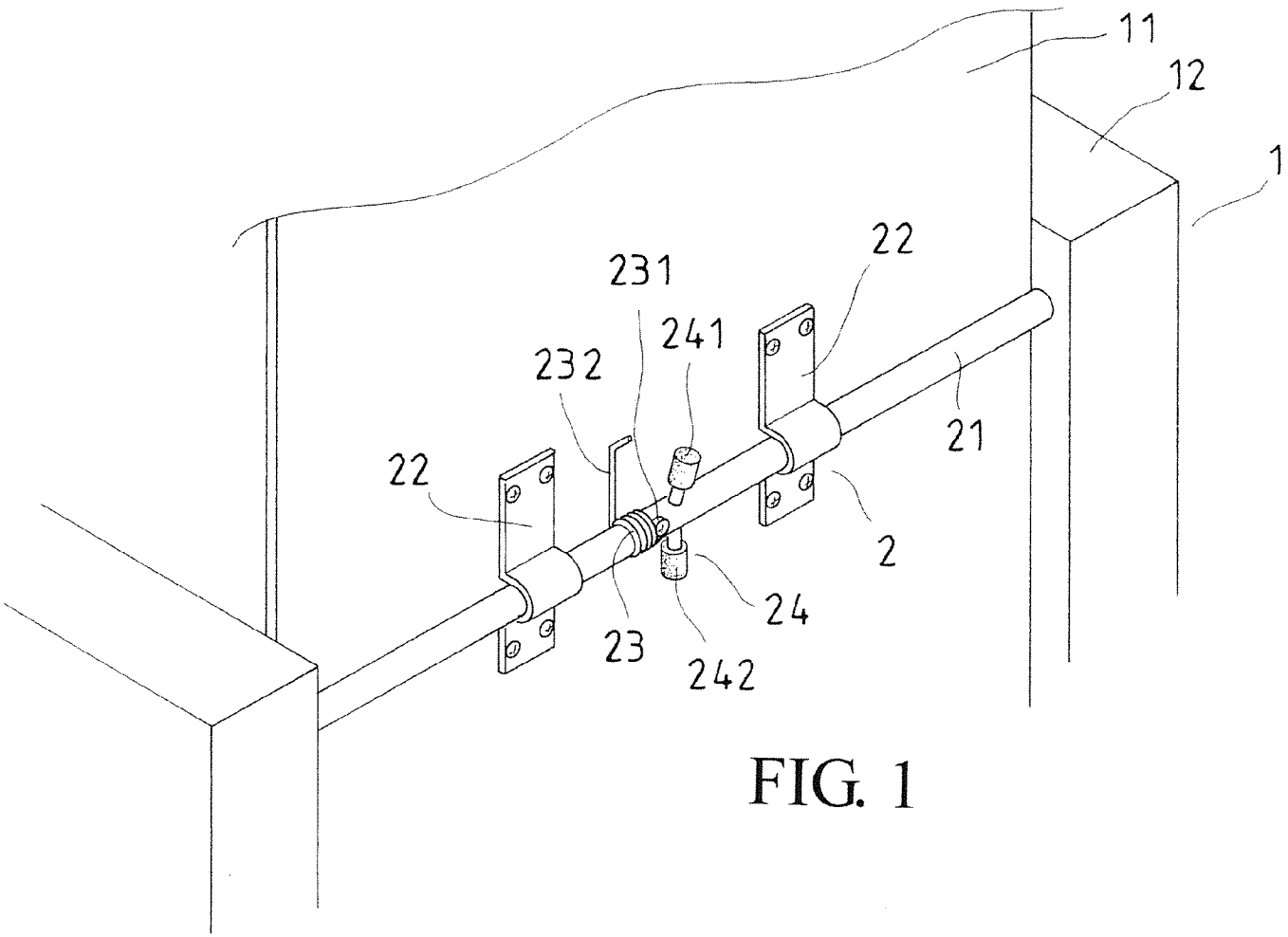
FIG. 1 is a perspective view to show the auto back-up unit of the present invention.
Figure 2:
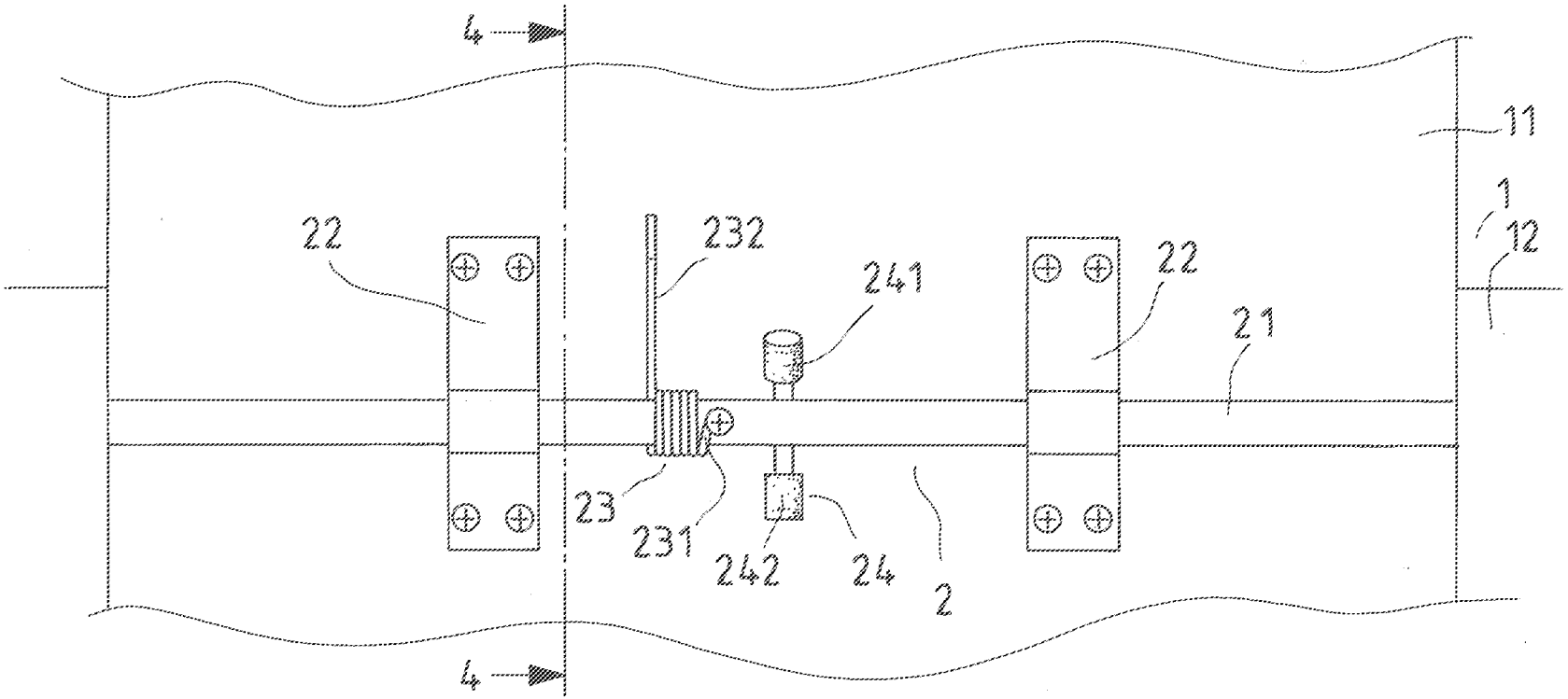
FIG. 2 is a plane view of the auto back-up unit of the present invention.

Referring to FIGS. 1 and 2, a seat 1 comprises a seat portion and a backrest 11. A back-up unit 2 of the present invention is connected to the backrest 11 and comprises a shaft 21 fixed to a rear side of the backrest 11 by at least one positioning member 22. Two ends of the shaft 21 are pivotably connected to two armrests 12 of the seat 1.

A resilient member 23 is mounted to the shaft 21 and comprises a positioning end 231 and a contact end 232, wherein the positioning end 231 is fixed to the shaft 21 and the contact end 232 contacts the backrest 11.

A restriction unit 24 is connected to the shaft 21 and has a first restriction portion 241 and a second restriction portion 242. The first restriction portion 241 restricts the inclination of the backrest 11 and the second restriction portion 242 restricts the angle of the backrest 11 when the backrest 11 backs up.

When the seat 1 not in use, as shown in FIGS. 1 to 4, the contact end 232 of the resilient member 23 contacts the of the backrest 11 so that the backrest 11 is in the upright position. The second restriction portion 242 of the restriction unit 24 restricts the angle of the backrest 11 which is in the upright position. Therefore, the distance between the front row and back row of the seats 1 is maintained.

Figure 3:
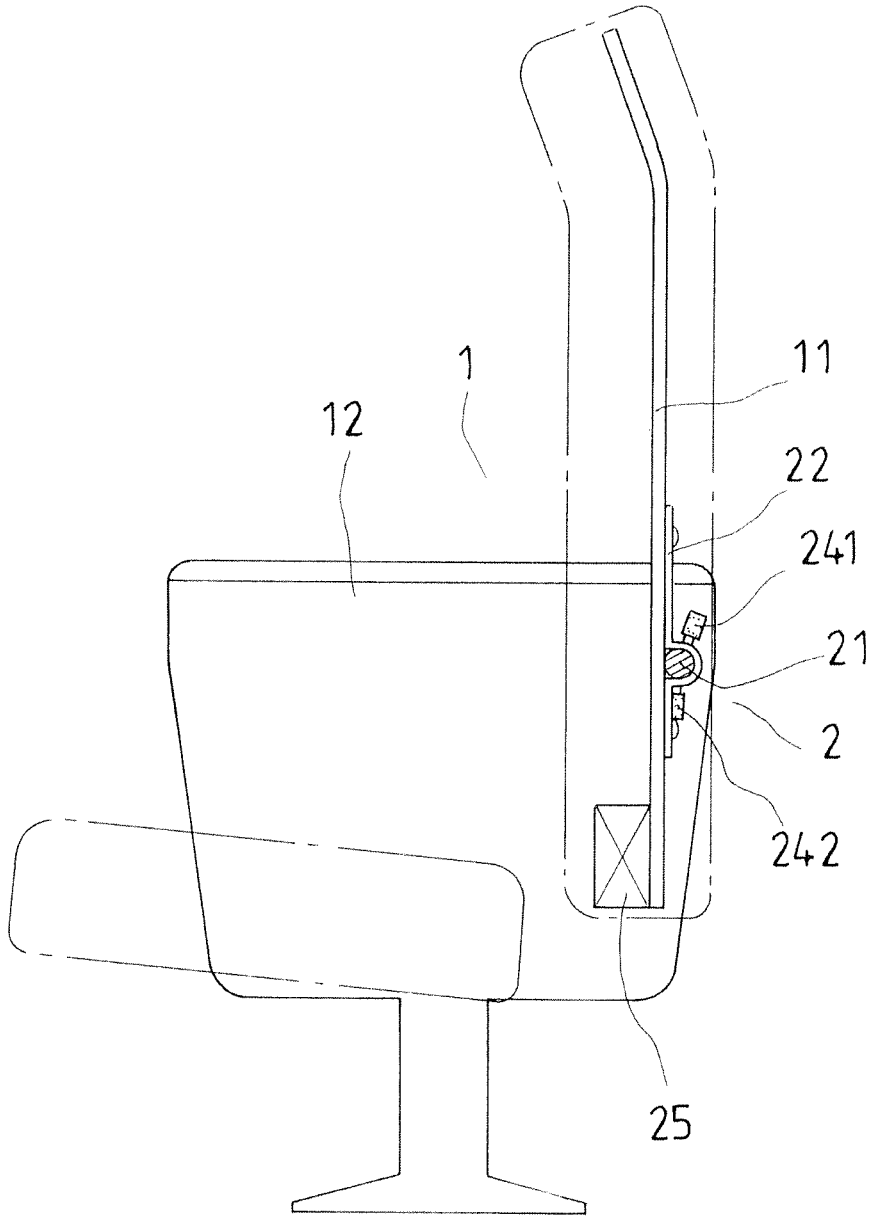
FIG. 3 shows that the backrest is in the upright position.
Figure 4:
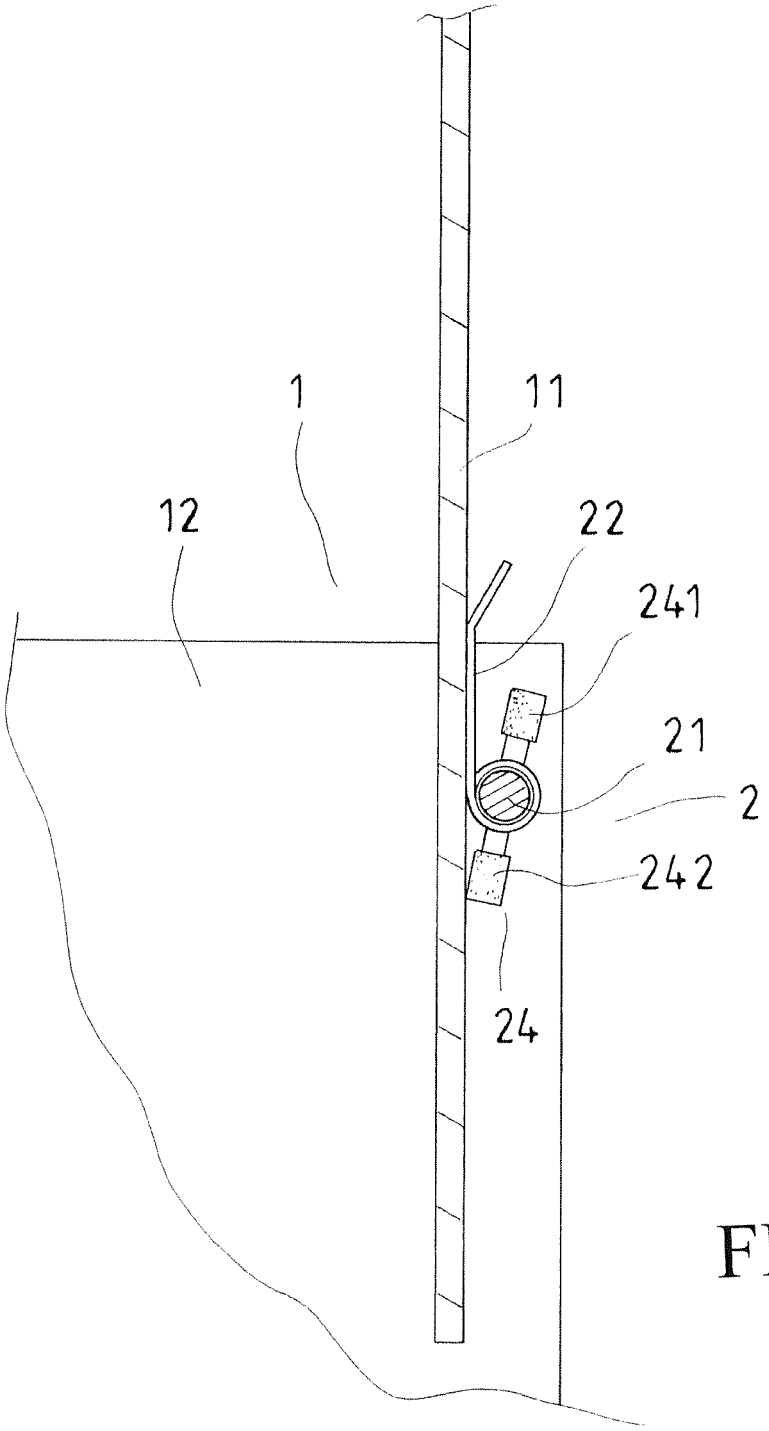
FIG. 4 is a partial cross sectional view of the auto back-up unit of the present invention taken along the Section Line 4-4 of FIG. 2 when the backrest is in the upright position.
Figure 5:
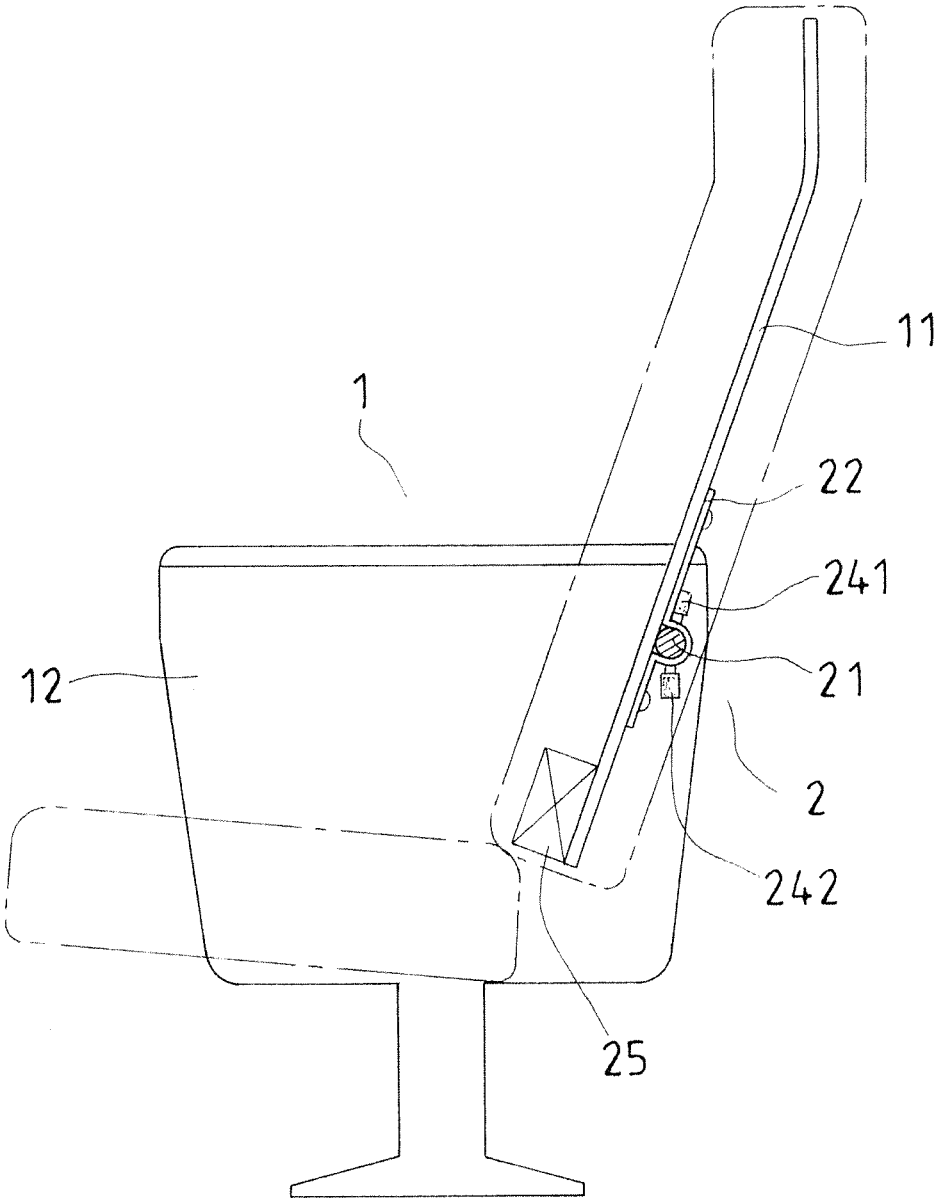
FIG. 5 shows that the backrest is in the inclined position.
Figure 6:
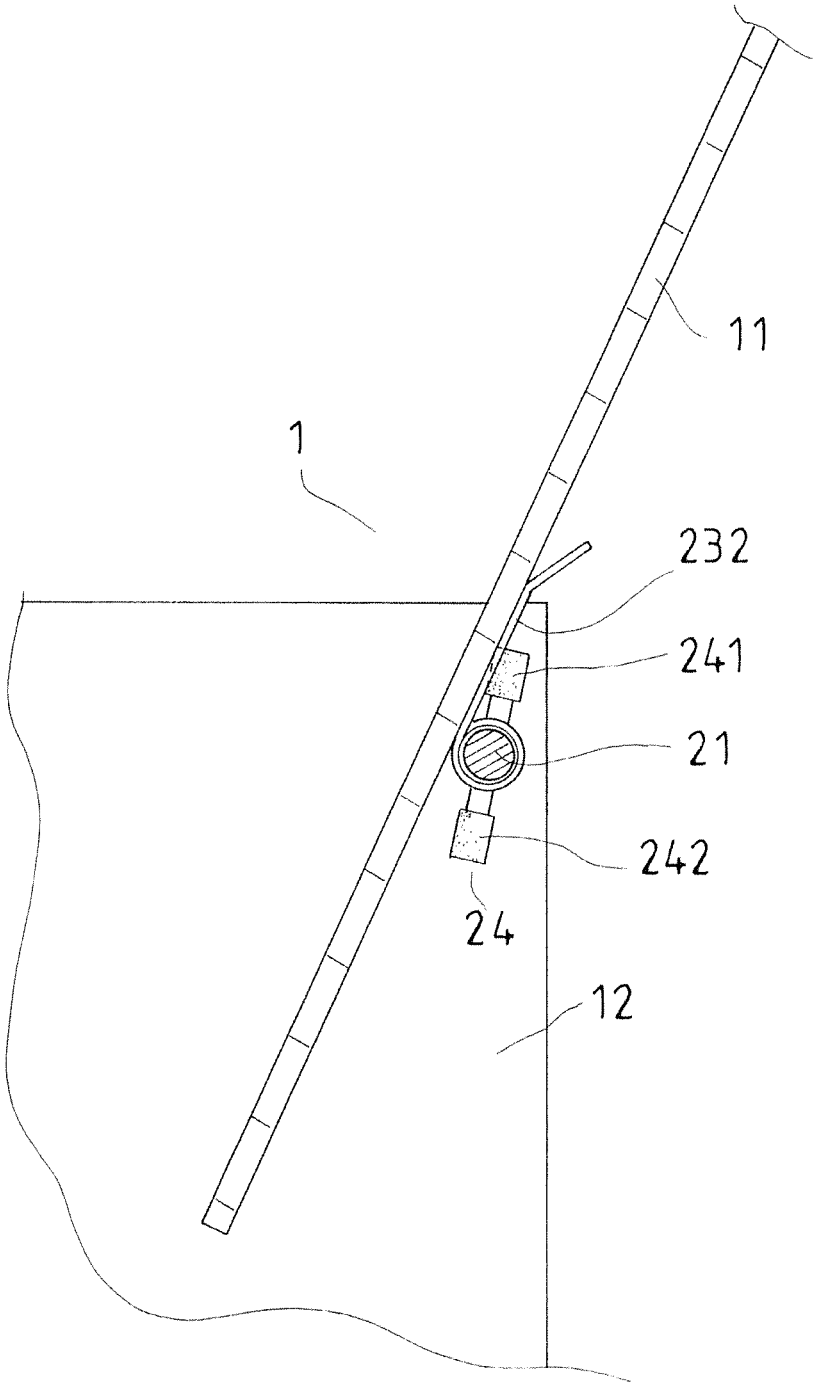
FIG. 6 is a partial cross sectional view of the auto back-up unit of the present invention taken along the Section Line 4-4 of FIG. 2 when the backrest is in the inclined position.

As shown in FIGS. 1, 2, 5 and 6, when a user sits in the seat 1, the backrest 11 tilts backward and the resilient member 23 is compressed. The first restriction portion 241 restricts the inclination of the backrest 11 so that the user rests on the backrest 11 at the comfortable angular position. As shown in FIGS. 3 and 4, when the user leaves from the seat 1, because no forces is applied to the backrest 11 so that the compressed resilient member 23 is released and the backrest 11 is pivoted to the upright position. The second restriction portion 242 restricts the backrest 11 at the upright position.

A weight 25 is connected beneath the backrest 11 so as to assist the operation of the resilient member 23.

The backrest 11 tilts backward when a user sits in the seat 1 and pivots forward to its upright position by the resilient member 23 and the restriction unit 24 when the user leaves from the seat 1. Therefore, the distance between the back row and front row of seats 1 is maintained.

There is no co-operated mechanism needed between the backrest and the seat portion or the armrests so that the manufacturing cost of the present invention is low.

While we have shown and described the embodiment in accordance with the present invention, it should be clear to those skilled in the art that further embodiments may be made without departing from the scope of the present invention.

What is claimed is:

1. A seat comprising:

a seat portion and a backrest;

a back-up unit connected to the backrest and comprising a shaft fixed to a rear side of the backrest by at least one positioning member, two ends of the shaft pivotably connected to two armrests of the seat;

a resilient member mounted to the shaft and comprising a positioning end and a contact end, the positioning end being fixed to the shaft and the contact end contacting the backrest; and a restriction unit connected to the shaft and having a first restriction portion and a second restriction portion, the first restriction portion restricting inclination of the backrest and the second restriction portion restricting an angle of the backrest when the backrest backs up.

2. The seat as claimed in claim 1, wherein a weight is connected beneath the backrest so as to assist operation of the resilient member.

* * * * *